United States Patent [19]

Rogers, Jr.

[11] 4,025,113

[45] May 24, 1977

[54] LINKAGE MECHANISM FOR HANDLE OPERATED RECLINER CHAIR

[75] Inventor: Walter Clark Rogers, Jr., Denton, N.C.

[73] Assignee: Royal Development Company, Inc., High Point, N.C.

[22] Filed: Apr. 9, 1976

[21] Appl. No.: 675,565

[52] U.S. Cl. ..... 297/434; 297/184; 297/271; 297/DIG. 7

[51] Int. Cl.[2] ..... A47C 7/50

[58] Field of Search ..... 297/84, 85, 271, 429, 297/434, DIG. 7

[56] References Cited

UNITED STATES PATENTS 3,815,954 6/1974 Rogers ..... 297/271

*Primary Examiner*—James C. Mitchell

*Attorney, Agent, or Firm*—William E. Mouzavires

[57] ABSTRACT

In a recliner chair having a handle operated footrest including footrest mechanisms on opposite sides of the chair, an improved linkage is provided for connecting the handle on one side of the chair with the footrest mechanism on that side of the chair to operate the same and for connecting the handle to the footrest mechanism on the other side of the chair to operate the same through means of a torque tube interconnecting the footrest mechanisms.

12 Claims, 3 Drawing Figures

LINKAGE MECHANISM FOR HANDLE OPERATED RECLINER CHAIR

RELATED PATENTS

The present invention constitutes an improvement over certain linkage mechanisms disclosed, for example, in U.S. Pat. No. 3,815,954, issued June 11, 1974, and U.S. Pat. No. 3,819,229, issued June 25, 1974, both of which patents are continuation-in-parts of U.S. Pat. No. 3,904,240, issued Sept. 9, 1975 which is a continuation of U.S. patent application Ser. No. 87,280, now abandoned.

INVENTION AND OBJECTS

The present invention generally relates to recliner chairs, including a footrest movable between extended and retracted positions by means of a manually operated handle mounted on one side of the chair, such recliner chairs being known or sometimes referred to in the industry as a "handle-operated recliner". Included herein are such reclining chairs which may also be mounted for rocking movement, such chairs being known or sometimes referred to in the trade as "handle-operated rocker recliners", however, the present invention need not be limited to recliner chairs which are mounted for rocking movement but may also be applied to recliner chairs which do not have provision for rocking movement.

More specifically, the present invention constitutes an improved linkage mechanism for mounting the footrest actuating handle to the chair and for connecting it to the footrest mechanism at one side of the chair to actuate the same and for connecting it to the footrest mechanism at the other side of the chair for actuating it in unison. Included herein is the provision of such a linkage mechanism which constitutes an improvement over the corresponding linkage mechanism disclosed, for example, in U.S. Pat. No. 3,815,954, as well as the other patents cited above.

One of the objects of the present invention is to provide a handle-operated recliner whose footrest may be quickly and easily operated between extended and retracted positions by means of a handle-operated linkage mechanism having a minimum number of parts which, moreover, may be arranged in the chair so as not to adversely affect the seat requirements or styling of the chair. Included herein is the provision of such a handle-operated recliner whose footrest will be positively held in the fully extended use position projected forwardly from the chair but at the same time, will permit retraction of the footrest in the case of excessive pressure applied to the footrest, such as through accident so as to avoid tipping of the chair or damage to the footrest mechanism.

Another object of the present invention is to provide a novel and improved linkage mechanism for operating a footrest incorporated in a handle-operated recliner and which linkage mechanism will carry out the above objects. Further included herein is the provision of such an improved linkage mechanism which may be applied to handle-operated recliner chairs or rocker recliner chairs of the prior art such as disclosed in the patents cited above or in new handle-operated recliners or rocker recliners while being compatible with the other linkage mechanisms included in the chair.

SUMMARY OF PRESENT INVENTION

In present day handle-operated recliners, it is customary, if not well-known, to interconnect the footrest mechanisms at opposite sides of the chair by means of a rigid member commonly known as a "torque tube". In this manner, actuation of one of the footrest linkage mechanisms on one side of the chair by means of a manually operable handle will be transmitted to the footrest linkage mechanism on the opposite side of the chair to actuate the same by means of the torque tube. In early and present day linkage mechanisms of the latter type, it is common to mount the links associated with the manually operated handle and the torque tube for movement about a common axis. While this was found to be satisfactory, it did in some cases limit the styling of the chair seat because the torque tube was positioned at too high of an elevation where it could adversely affect the depth of the seat cushion and the seat springs. In addition, in some cases, it was found that the handle was positioned a bit too low to allow convenient grasping by the chair occupant for purposes of operating the footrest between extended and retracted positions.

Very briefly described, the present invention improves over the above linkage mechanism by separating the pivot axes of the handle and the torque tube so as to permit the handle to be at a sufficiently high elevation for convenience of the chair occupants, while permitting the torque tube to be at a sufficiently low elevation so as not to interfere with the seat springs or other seat cushion requirements. In addition, the present invention increases the leverage for operating the footrest mechanism betwen extended and retracted positions.

DRAWINGS

A more detailed description of the linkage mechanism of the present invention, together with other objects, advantages and features thereof, is set forth below in conjunction with the attached drawings in which:

FIG. 1 is a side elevational view of a frame of a handle-operated rocker recliner chair incorporating the improved linkage mechanism of the present invention and shown with its footrest in fully retracted position;

FIG. 2 is an enlarged, side view of the improved linkage mechanism embodying the present invention as would be seen from the inside of the associated recliner chair when the footrest is in a fully extended or substantially fully extended position; and FIG. 3 is an exploded perspective view of the improved linkage mechanism of the present invention when in the position corresponding to that shown in FIG. 2.

DETAILED DESCRIPTION

Figure 1:
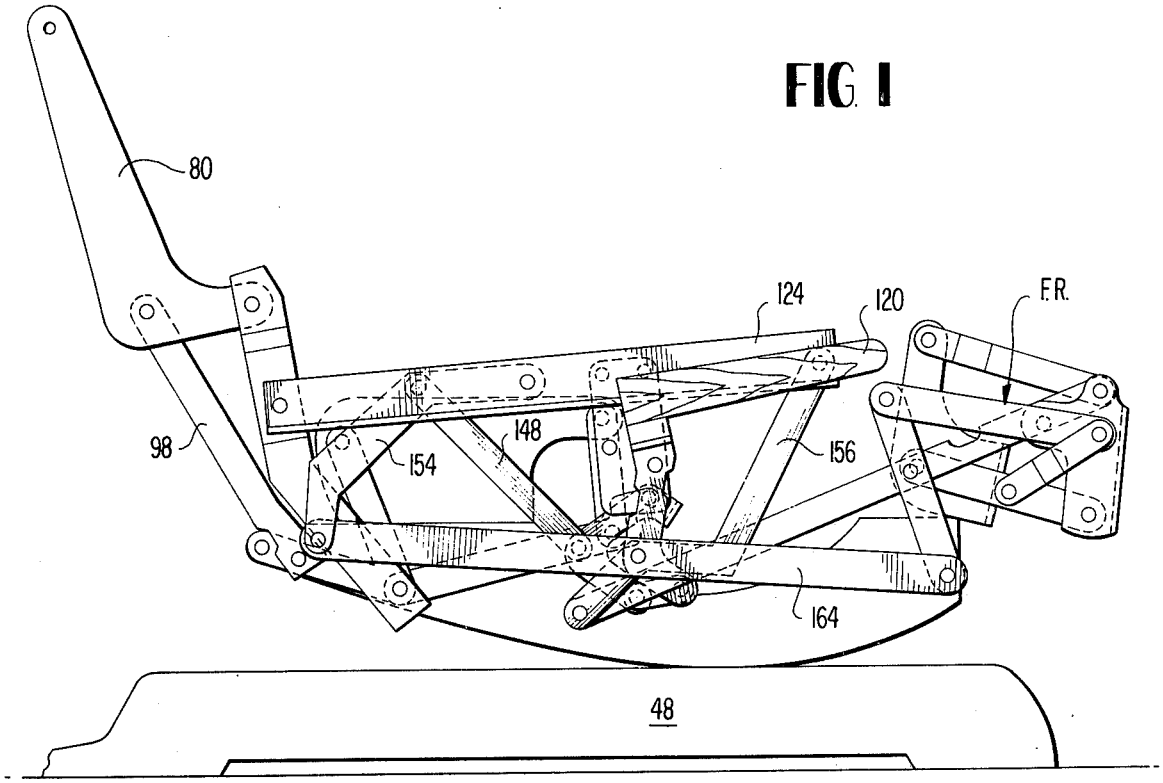

Referring now to the drawings in detail, FIG. 1 illustrates a frame of a handle-operated rocker recliner chair shown, for example, in U.S. Pat. Nos. 3,815,954, 3,819,229 and 3,904,240, identified above; the disclosures of which patents are hereby incorporated by reference into this application as part hereof. Therefore reference may be had to the disclosures of these patents for a description of each of the parts of the chair, including the various linkage mechanisms. For this purpose, many of the numerals used in said patents are also used in the present application to identify the same or corresponding parts.

Figure 2:
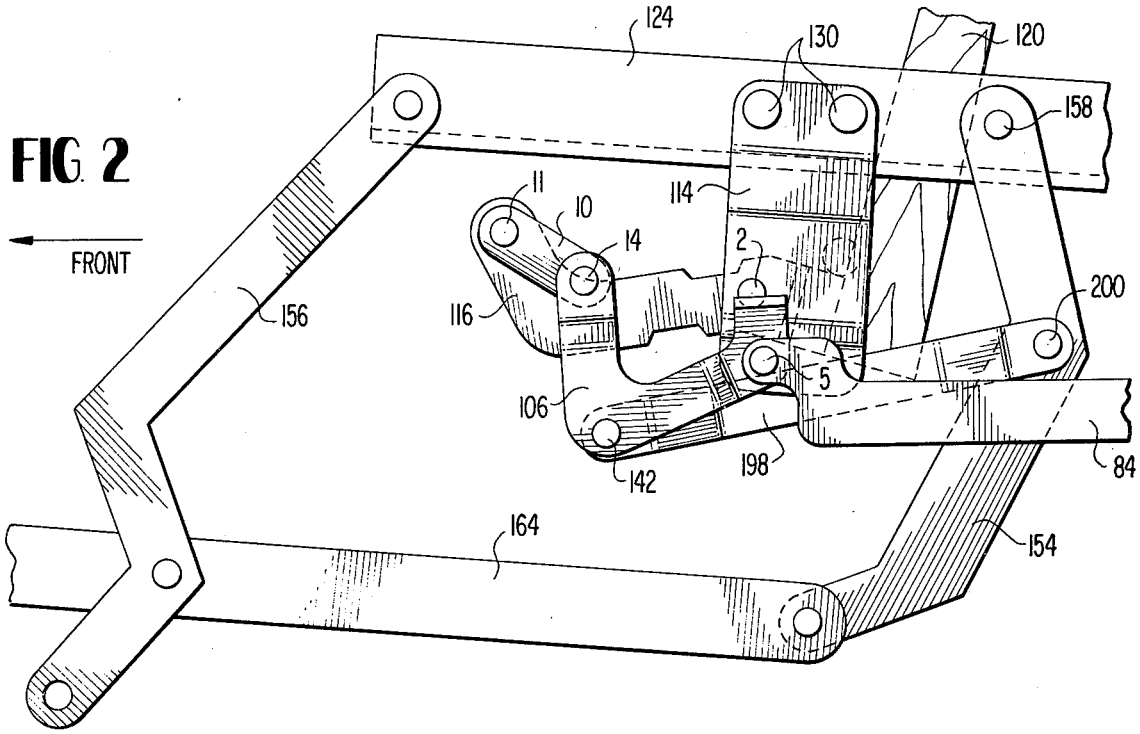
Figure 3:
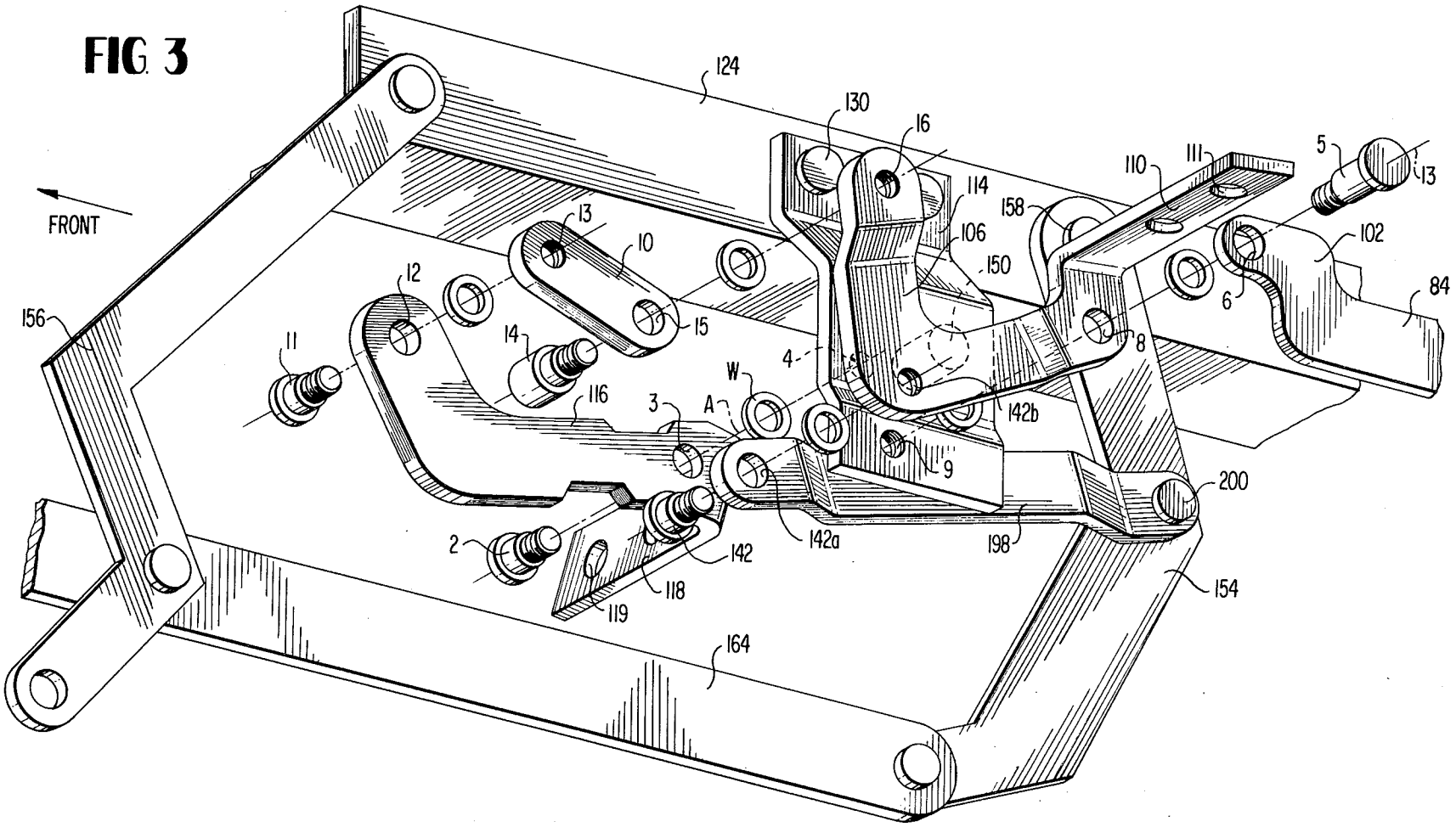

The linkage mechanisms disclosed in FIGS. 1, 2 and 3 of the present application are located on one side of the associated rocker recliner chair. The linkage mechanisms on the opposite side of the chair are not shown but are substantially identical except for the linkage mechanism of the present invention.

The linkage mechanism of the present invention mounts the footrest actuating handle 120 to the chair and operatively connects handle 120 to the footrest linkage on one side of the chair and to the footrest linkage on the opposite side of the chair; the latter connection occurring through means of a torque tube connected to the improved linkage of the present invention and extending across the chair to operate the footrest linkage at that side of the chair in unison with the footrest linkage which is directly operated by the handle.

The preferred embodiment of the present invention is shown in the drawings in connection with a rocker recliner chair as noted above, including a seat link 124 having a plate 114 rigidly fixed thereto by means of fasteners 130 and depending below seat link 124; these parts being adequately described in the three patents cited above. The footrest of the chair includes a footrest linkage generally designated FR in FIG. 1 movable between a retracted position adjacent the front of the chair as shown in FIG. 1 and an extended position (not shown) where the footrest is projected forwardly from the front of the chair. Actuation of the footrest between extended and retracted positions is achieved by handle 120 which is grasped by the chair occupant and pivoted about a horizontal axis A to actuate the footrest mechanism through actuation of footrest links 154 and 164 as will be described below.

Footrest actuating handle 120 is rigidly fixed such as by screws, not shown, to an outwardly extending flange 118 of a link 116 which will be termed herein the "handle link". The major portion of handle link 116 is comprised of a generally L-shape with flange 118 projecting outwardly of the chair at generally right angles to the L-shaped portion as best shown in FIG. 3 of the drawings. Handle link 116 is mounted for pivotal or rotational movement about a horizontal axis A (see FIG. 3) on mounting plate 114 which, as noted above, depends from seat link 124 to which it is rigidly fixed.

This pivotal mounting is achieved by a pivot 2 received through an aperture 3 in handle link 116 and secured such as, for example, by threads in aperture 4 of mounting plate 114. Preferably, a washer W is inserted between handle link 116 and mounting plate 114 about pivot 2. Similar washers are used in other mountings to be described below and are shown in drawings and need not be specifically described in each instance.

As noted above, the footrest linkage mechanisms on the opposite sides of the chair are interconnected by a torque tube (not shown) so that when handle 120 is actuated to operate the associated footrest linkage mechanism on one side of the chair, the footrest linkage mechanism on the opposite side of the chair will be simultaneously actuated by means of the torque tube. Although the torque tube (not shown) may be a metallic tubular structure, it should be understood that it may also be provided by a solid bar, rod or other member sufficiently strong to transmit motion and force from the handle linkage mechanism of the present invention to the footrest linkage on the opposite side of the chair.

The torque tube is rigidly fixed to a torque tube link 106. In the specific preferred embodiment shown, torque tube link 106 has a generally V-shape or U-shape and includes an inwardly extending flange 110 having a plurality of apertures 111 for securing the torque tube (not shown) rigidly relative to the torque tube link 106 such as by fasteners (not shown) received through apertures 111.

Torque tube link 106 is mounted for pivotal or rotational movement about a second horizontal axis B on mounting plate 114; axis B being at an elevation below axis A of the handle link 116. This mounting of torque tube link 106 to plate 114 is achieved by a pivot 5 received through an aperture 8 in torque tube link 106 and an aperture 9 in mounting plate 114, the latter having screws for securing pivot 5 therein. While in the specific embodiment shown directed to the rocker recliner chair disclosed in said patents identified above, the link 84 and its extension 102 (see FIG. 3) receives the pivot 5 of the torque tube link 106, it should be understood that the present invention need not be limited to such and that in other recliner chairs such a connection to torque tube link 106 may be omitted.

Actuation of torque tube link 106 about axis B and pivot 5 for moving the torque tube for actuating the footrest linkage mechanism on the opposite side of the chair (not shown), is achieved through a short linkage connection in the form of a straight short link 10 having its opposite ends pivotally interconnected to handle link 116 and torque tube link 106. In the specific embodiment, this connection is achieved by means of a pivot 11 received through an aperture 12 of handle link 116 and secured in a threaded aperture 13 in one end of short link 10. The opposite end of short link 10 is provided with an aperture 15 receiving another pivot 14 which is secured in aperture 16 in one end of torque tube link 106.

Actuation of the footrest linkage FR (see FIG. 1), including footrest links 154 and 164 (also see FIG. 3) when the handle is moved from the position shown in FIG. 1 (when the footrest is fully retracted) to the position shown in FIGS. 2 or 3 (when the footrest is extended), is achieved through means of link 198 having one end pivotally connected to an intermediate portion of link 154 by pivot 200. The other end of link 198 is pivotally connected to torque tube link 106 by means of pivot 142 received through aperture **142*a* of link 198 and secured in aperture 142*b* in torque tube link 106**.

From the above, it will be seen that when the footrest is fully retracted, handle 120 will extend forwardly as shown in FIG. 1. When it is desired to extend the footrest, handle 120 is grasped and moved counterclockwise as viewed in FIG. 1 which will cause handle link 116 to pivot about axis A (pivot 2) until the handle reaches the position generally shown in FIG. 2 at which point the footrest will have been fully extended. This position of the footrest linkage and the linkage mechanism of the present invention is determined and limited by the short link 10 interconnecting handle link 116 and torque tube link 106 which prevents further movement of the handle about pivot 2 in the direction which would have tended to further extend the footrest. Extension of the footrest caused by moving the handle shown in FIG. 1 to the position shown in FIG. 2 is achieved through link 198 which interconnects torque tube link 106 and footrest link 154 to actuate the latter about pivot 158 to extend the footrest linkage FR; it being understood that torque tube link 106 being interconnected to handle link 116 by short link 10 will be driven by short link 10 during movement of handle 120 as aforesaid. As described above, the footrest linkage on the opposite side of the chair will be actuated at the same time via the torque tube which is connected to flange 110 of torque tube link 106.

When the footrest is in the extended position, the linkage mechanism of the present invention, including handle link 116, torque tube link 106, short link 10, and link 198 will positively hold the footrest in the extended position against inadvertent or accidental retraction. However, in the case of excessive force being applied to the footrest when in the extended position, the linkage mechanism of the present invention will permit the footrest linkage to be retracted to prevent tipping of the chair and/or damage to the footrest linkage.

When it is desired to retract the footrest, handle 120 is grasped and pivoted from the position shown in FIG. 2 back to the position shown in FIG. 1 which is determined by engagement of handle link 116 with a stop 150 formed on the outer side of mounting plate 114. Stop 150 may be in the form of a stud fixed to plate 114.

It will be seen that the present invention permits the pivot axes A and B of the handle 120 and torque tube link 106, respectively, to be separated from each other so that the handle may be elevated to allow convenient grasping by the chair occupant and so that the torque tube may be lowered so as not to interfere with the seat cushion or springs, or seat frame or other styling or design requirements of the chair. In addition, the present invention provides greater leverage for projecting the footrest and further, in this regard, the throw of the handle from the retracted position shown in FIG. 1 to the extended position shown in FIG. 2 is reduced by the present invention.

Although the specific shapes and relative sizes of each of the links of the mechanism of the present invention has not been described in complete detail, reference may be had to the attached drawings for such information. It is understood, however, that the scope of the invention is not to be limited to the preferred embodiment shown but rather is indicated in the appended claims.

What is claimed is:

1. In a handle-operated recliner chair, including a footrest movable between a retracted position adjacent the front of the chair, and an extended position projected forwardly from the front of the chair, the footrest including two footrest linkages mounted on opposite sides of the chair for extending and retracting the footrest relative to the chair and a torque transmitting member extending across the chair interconnecting said footrest linkages such that actuation of one footrest linkage will be transmitted to the other footrest linkage; the improvement comprising hand-operated linkage means connected to said one footrest linkage for actuating the same between extended and retracted positions, including a handle link mounted for pivotal movement about a first horizontal axis, a manual operating handle connected to said handle link for pivoting the same about said first axis, a second link connected to said torque transmitting member and being mounted for pivotal movement about a second horizontal axis located below said first horizontal axis, and linkage means interconnecting said handle link and said second link for transmitting motion from said handle link to said second link, and wherein one of said handle link and second link is connected to said one footrest linkage for actuating the same when the handle is moved to pivot said handle link about said first axis.

2. The improvement defined in claim 1 wherein said second link is connected to said one footrest linkage.

3. The improvement defined in claim 1 wherein said handle link includes a flange portion projecting outwardly of the chair from the plane of the handle link and wherein said handle is fixed to said flange portion; and wherein said second link has a flange portion projecting inwardly of the chair from the plane of the second link and wherein said torque transmitting member is fixed to said flange portion of said second link.

4. The improvement defined in claim 3 wherein said handle link includes a generally L-shaped major portion and wherein said second link includes a generally V-shaped major portion, and wherein said linkage means interconnecting said handle link and said second link is a short link pivotally connected to ends of said major portions of said handle and second links.

5. The improvement defined in claim 1 further including first stop means for limiting movement of the handle in one direction to determine the fully extended position of the footrest, and second stop means for limiting movement of the handle in an opposite direction to determine the retracted position of the footrest.

6. The improvement defined in claim 5 wherein said first stop means includes said linkage means interconnecting said handle and second links and wherein said second stop means includes a stop fixed relative to the chair to be engaged by said second link.

7. The improvement defined in claim 6 wherein said chair includes a mounting member fixed to a frame portion of the chair, and wherein said handle link and second link are pivotally mounted to said mounting member, and wherein said stop is fixed to said mounting member.

8. For use in combination with a handle-operated recliner chair including a footrest movable between extended and retracted positions, and two footrest linkages on opposite sides of the chair for moving the footrest between said extended and retracted positions, and a torque transmitting member interconnecting said footrest linkages to transmit motion from one footrest linkage to the other footrest linkage; a manually operated handle and linkage assembly for manually operating one of said footrest linkages, the assembly comprising a first handle link adapted to be pivotally mounted relative to the chair for movement about a first horizontal axis, a handle connected to said handle link to pivot the same about said first horizontal axis, a second link adapted to be pivotally mounted relative to the chair for movement about a second horizontal axis and to be fixed to the torque transmitting member of the chair, a third link interconnecting said handle link and said second link to transmit motion from the handle link to said second link, and a fourth link having one end pivotally connected to one of said handle link and second link and an opposite end adapted to be pivotally connected to said one footrest linkage to operate the same in response to movement of said handle link about said first axis.

9. The assembly defined in claim 8 wherein said fourth link is pivotally connected to said second link.

10. The assembly defined in claim 8 wherein said first axis is located at an elevation higher than said second axis.

11. The assembly defined in claim 8 further including a mounting plate adapted to be fixed to the chair, said handle link and second link being pivotally mounted to said mounting plate for movement about said first and second axes.

12. The assembly defined in claim 11 further including a stop means on said mounting plate engageable with said handle link for limiting movement of the handle link about said first axis in one direction.

* * * * *